US006366222B1

(12) United States Patent
Russell, Jr.

(10) Patent No.: US 6,366,222 B1
(45) Date of Patent: Apr. 2, 2002

(54) ABLE TO OPERATE TAG

(76) Inventor: Edward L. Russell, Jr., 4074 Rivermist Ct., Lithonia, GA (US) 30038

( * ) Notice: Subject to any disclaimer, the term of this patent is extended or adjusted under 35 U.S.C. 154(b) by 0 days.

(21) Appl. No.: 09/086,223

(22) Filed: May 28, 1998

Related U.S. Application Data

(60) Provisional application No. 60/075,307, filed on Feb. 2, 1998.

(51) Int. Cl.[7] ..... G06G 1/01

(52) U.S. Cl. ..... 340/933; 340/426; 340/572.1

(58) Field of Search ..... 340/928, 933, 340/568.1, 572.1, 988, 425.5, 426, 568.6, 573.7, 539; 342/42, 44, 47, 50, 51; 235/384

(56) References Cited

U.S. PATENT DOCUMENTS 4,015,259 A * 3/1977 Silverhus et al. ..... 342/44
5,310,999 A * 5/1994 Claus et al. ..... 235/384
5,434,013 A * 7/1995 Fernandez ..... 428/690
5,508,705 A * 4/1996 Spiess ..... 342/44
5,634,670 A * 6/1997 Orensteen et al. ..... 428/40.1

* cited by examiner

*Primary Examiner*—Van T Trieu

(57) ABSTRACT

The central monitoring station electromagnet wave will transmit to satellite, return to earth and activate the electronic component on motor vehicles. The light on the license plate will then be activated. This phase acts as legal registration to operate your motor vehicle this light will remain in a on status as long as you are legally on the road. Legal status applies except in the following circumstances, an unisured motorist, driver license is suspended, vehicle reported stolen, outstanding warrants, unpaid traffic tickets, and unpaid child support.

8 Claims, 4 Drawing Sheets

ABLE TO OPERATE TAG

This application claims benefit of 60/075,307 filed Feb. 2, 1998.

FIELD OF INVENTION

This invention relates to motorized vehicles, specifically to the improvement and safety of motorized vehicles. The system is an activated state license plate containing an electronic component activated by a satellite transmission.

Primary Components (1) SATELLITE (2) CENTRAL MONITORING SYSTEM (3) MOTOR OPERATED VEHICLE

DESCRIPTION OF PRIOR ART

In regard's to a.t.o.t. part of the reason that car thieves are becoming more adapted at stealing vehicles is that they keep pace with every new anti-theft device on the market.

One of the tactical advantage they enjoy is time to consider and develop countermeasures to the new devices. Steering columnlocks, ignition coils, fuel line cutoff devices are well publicized in popular technology magazine. The car thief also gains hands-on experence against such equipment with his own car.

As a result the variety of anti-thief device currently being marketed ranges widely from interlock system for the ignition to keyless digital combination locks, on to sirens that sound when a delicate sensing system is interrupted. However in spite of all the engineering time and money that has been invested in auto theft equiment in resent years, vehicles theft statistic have not substantially improved. In 1991 over 1.66 million vehicles were reported stolen in the United States up 1.6 percent over the 1.64 million vehicles stolen in 1990. By region 32 percent of the motor vehicles thefts occurred in the southern states, 24 percent by the northeastern states, 26 percent by the western states, 18 percent by the midwestern states. Monthly volume statistics show the greatest number of vehicile theft in August, and the least during February.

For every 100,000 inhabitants living in m.a.s. (mass statistical areas) there were 659 motor vehicle thefts reported in 1991. The rate in metropolitan statistical areas the rate was 803 per 100,000 of population. In cities outside metropolitan areas the rate was 223. And in previous years, the highest rate were in the nation's most heavily populated monicipalities indicating the offence is primarily a large city problem. By the percentage of vehicles stolen and the region of the theft occurrance. The inverse of truck and bus theft.

For example, in the northeastern states, 92.7 percent of all vehicles stolen were auto, while 4.4 percent were trucks and buses, and 2.9 percent were other vehicles in western states, 71.4 percent of all vehicles thefts were auto, 21.9 percent were trucks and buses, and 6.8 percent were other vehicles. The estimated national loss due to motor vehicle theft was estimated to be 8.3 billion for 1991, with the average vehicle worth 4,983.00 nationwide in 1991. Only 14 percent of the theft cases were cleared by local law enforcement agencies. Those in cities cleared 16 percent, and those in rural areas cleared 33 percent. Highway shooting, drive-by, and carjacking have also placed the concern for personal safety squarely in the laps of the average motorist. Carjacking (stealing a car from the owner at gunpoint) has mushroom in cities like Detroit, Mich. and Houston, Tex. and since spread to other cities. In Los Angeles some 4,000 carjacking occurred in 1991.

SUMMARY OF INVENTION

The concept of a.t.o.t. is an actual motor vehicle registration tag that would include an electronic transponder feature to indicate legal and proper status for operation of a vehicle on public highway. This electronic registration tag would be self contained and would attach to a motor vehicle licence plate at the location normally reserved for conventional registration tag. The micro-electronic in the tag would be in communication with an orbiting communication satellite. As long as the current vehicle registration is valid the a.t.o.t. system would appear illuminated thereby providing highway patrol officers with a simple means of determining the legal status of a motor vehicle or operator at a glance. Should the vehicle be reported stolen, the owner's insurance is cancel, and or the operator's license would be revoked, the a.t.o.t. could be remotely turned off. Thereby indicating that the vehicle may not be operating in a legal manner. The appealing feature of a.t.o.t. would be the use of the self-contained electronic transponder tag and satellite. The system will provide the remote and automatic means of visible indication the legal operating status of motor vehicles. Valid a.t.o.t. would illuminate normally while vehicles reported as stolen, unisured, having an expired registration, unpaid ticket's, outstanding warrant's, unpaid child support payment's or possibly operated by a vehicle owner with a revoked driver's license could be readily identified by a police via the non-illuminated tag.

BRIEF DESCRIPTION OF THE DRAWING

FIG. (1-A) Looking from the back end of the tag that would be on the licence plate.

FIG. (1-B) Looking from the back end of the tag that is on the licence plate.

Figure 1:
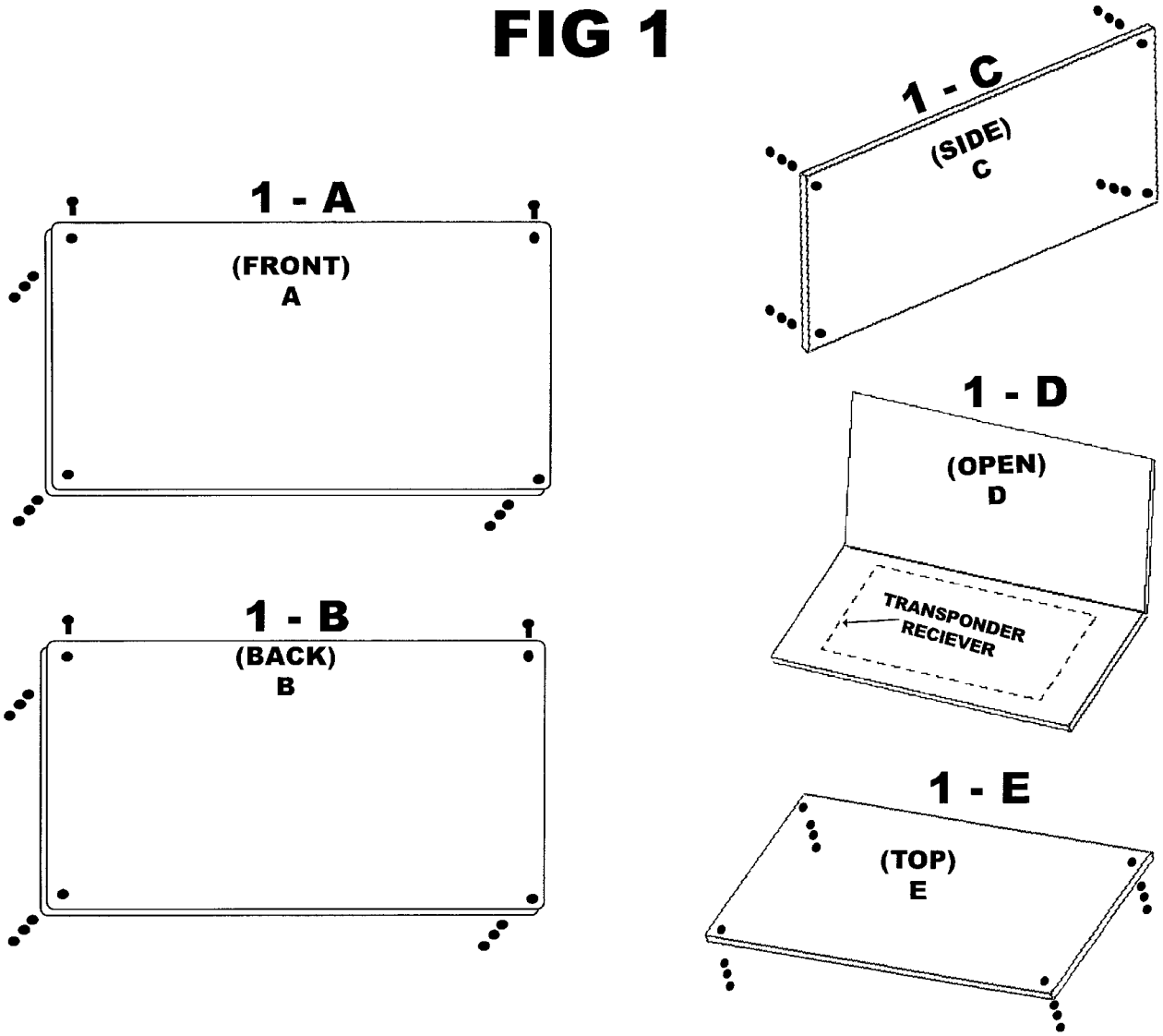
Figure 2:
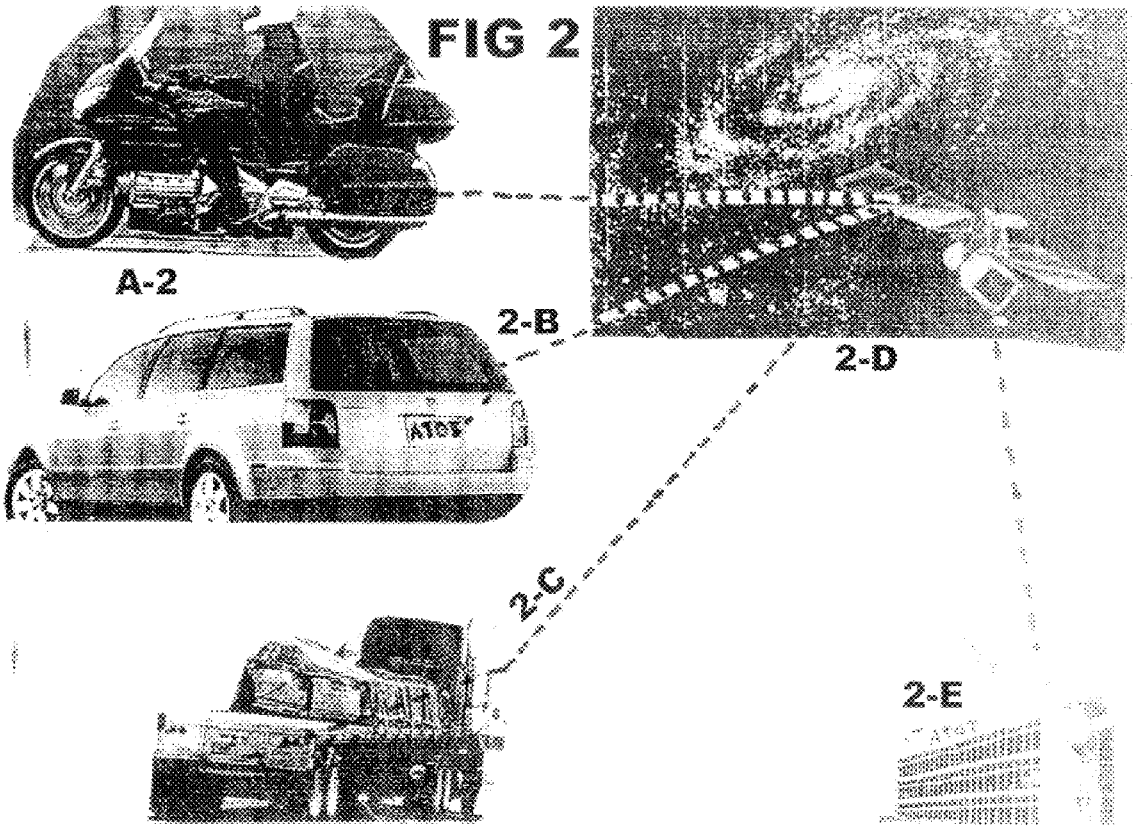
Figure 3:
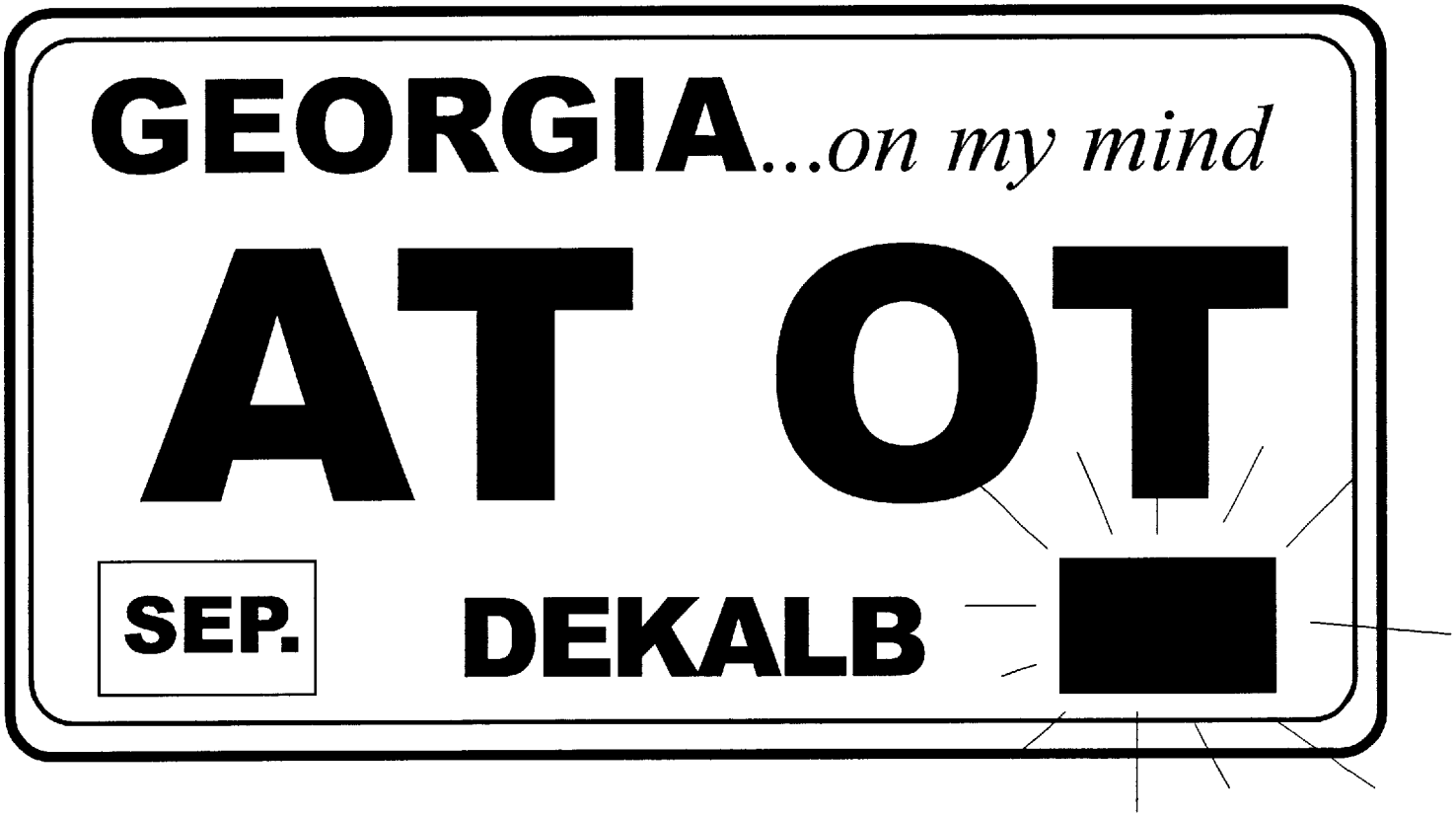
Figure 4:
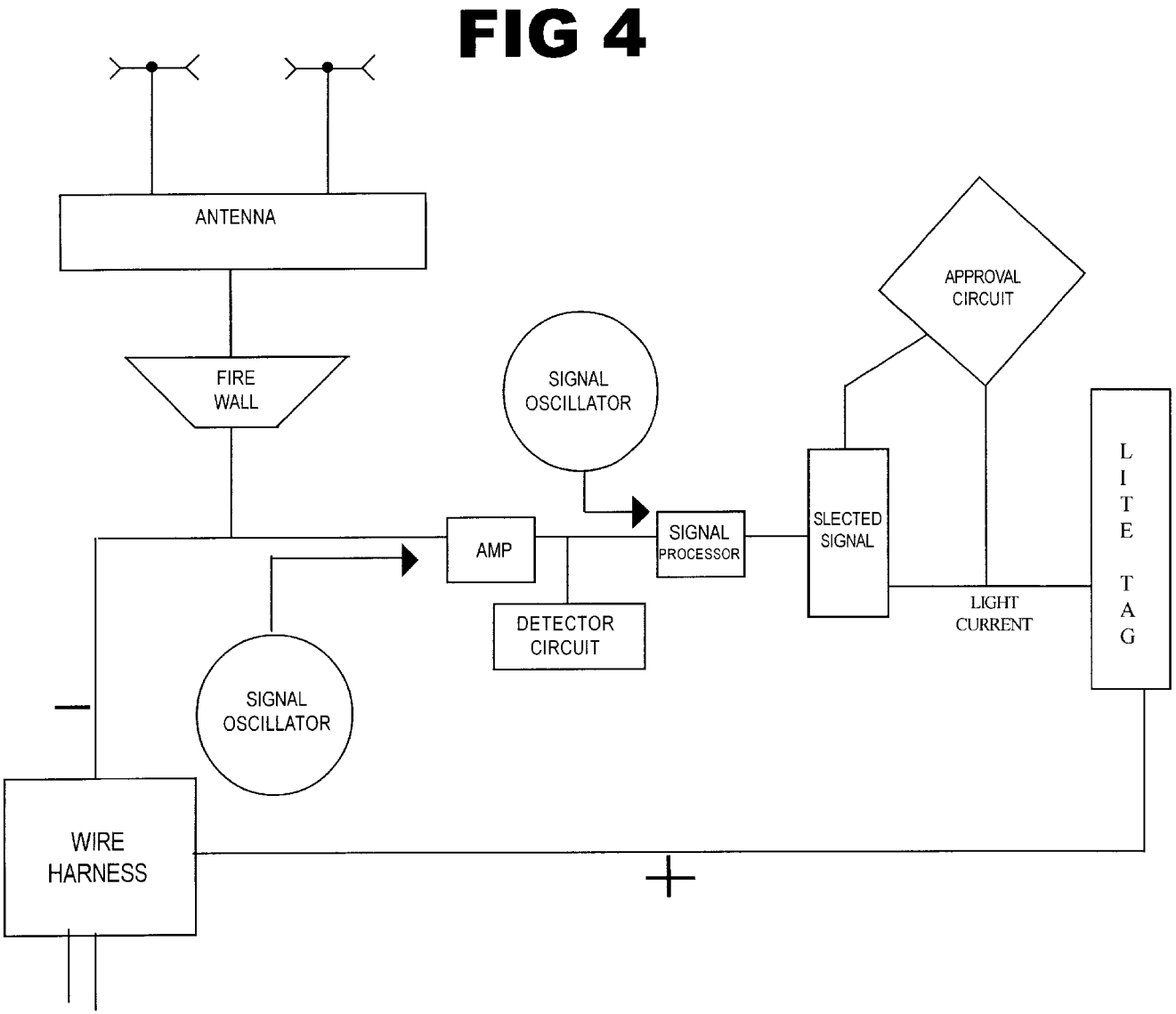

FIG. (1-C) looking from the left side of the tag on the licence plate.

FIG. (1-D) Looking as if the tag were opened up.

FIG. (1-E) Looking down as if you were on top of the tag.

FIG. (2-A) A motorize vehicle on the road.

FIG. (2-B) A motorize vehicle on the road.

FIG. (2-C) A motorize vehicle on the road.

FIG. (2-D) An obiting satellite.

FIG. (2-E) Building with a satellite dish.

FIG. (3) A state licence plate.

FIG. (4) A drawing of the schematic diagram of a.t.o.t. tag.

DESCRIPTION OF PREFERRED EMBODIMENTS

FIG. (1-A) Looking from front side of the illuminated tag that would be on the state licence plate. The fastener that will connect the hardware together. The power supply will be connected to the electrical system of the motorized vehicle.

FIG. (1-B) Represent's the back of the tag. The power supply is connected to the electrical section of the motorized vehicles.

FIG. (1-C) Looking from the left side of the tag. The fastener that will connect the front and back together. The power supply coming from the motorized vehicles.

FIG. (1-D) The view from as the tag would look like if opened. The top has been open horizonial. The make up of the a.t.o.t. system, the code for activation, the receiver, and all other coponets nessasary for a.t.o.t. are located in this section. The power supply is connected to the motorized vehicle.

FIG. (1-E) Looking down from top of a.t.o.t. tag. The power supply goes to the electrical system.

FIG. (2-A) The motorized vehicle called a motor cycle 1997 est. 3.8 million no the road today.

FIG. (2-B) The motorized vehicle called automobile 1997 est. 3.8 million on the road.

FIG. (2-C) The motorized vehicle called truck or trailer est. 5.3 million on the road. s.u.v. and vans est. 70 million, buses est. 689,000.

FIG. (2-D) The satellite that activates the a.t.o.t. system.

FIG. (2-E) The satellite dish that transfers the information to the satellite and the monitoring center that receives information from local, state, or federal agency on connection notices.

FIG. (3) This tag is from Georgia with the new system.

FIG. (4) The antenna in which receive the signal from the orbiting satellite. The firewall protects from any illegal or unauthorized entry into the tag itself. The signal oscilator generates a particular frequency of A.C. Ampliler circuit, a circuit that increases the power of a current. Detector circuit, a circuit that separates an information signal from the overall signal. Rectifier circuit, a circuit for changing a.c. to d.c. electronic devices need d.c. power. Sign processor, processes the signal thats comes from the orbiting satellite and matches it with the code that the tag has in its data bank. Slected signal combines both codes the one from the satellite and the tag, then sends a lite current to the tag face via approval circuit. Approval circuit, circuit that allows activation when legal to operate on the road (paid tags, paid insurance, no tickets, fines, warrants, revoked drivers licence, unpaid child support, or stolen vehicle.) lite tag the lighted tag itself. Positive wire of the tag. Negitive wire of the tag. Wire harness what is wired to the electrical system of the vehicle.

What is claimed is:

1. A system for monitoring information on licensed person and/or a legal registration of a motor vehicle driving on the road comprising; an orbiting satellite, an electronic registration tag being attached to a motor vehicle license plate, and communication means to communicate between said orbiting satellite and said electronic registration tag for illuminating said vehicle license plate only when the person and/or the vehicle registration being determined proper or valid.

2. According to claim 1 activation occurs when information from said person or persons vehicle is link to code number.

3. According to claim 1 said code number is then transmitted and linked to an orbiting satellite.

4. According to claim 1 after said number is received it builds a firewall around the code number and the information is processed the satellite switches into transmission mode.

5. According to claim 1 the orbiting satellite transmit its own wave back to earth in search of the matching code that is in its data bank.

6. According to claim 1 with in seconds after the satellite transmission the code number is linked to the proper registration tag.

7. According to claim 1 activation is confirmed by the illuminated registration tag that is on the licence plate.

8. According to claim 1 the registration tag consist of a transmitter and a receiver especially made to receive the wave from the satellite.

* * * * *